US005380262A

United States Patent [19]

Austin

[11] Patent Number: 5,380,262

[45] Date of Patent: Jan. 10, 1995

[54] COMBINATION COLLAPSIBLE CHAIR AND WALKER DEVICE

[76] Inventor: Ben R. Austin, 1215 St. Albans Rd., San Marino, Calif. 91108

[21] Appl. No.: 226,826

[22] Filed: Apr. 13, 1994

[51] Int. Cl.[6] ..... A63B 22/20; A61H 3/04

[52] U.S. Cl. ..... 482/68; 297/5; 280/647

[58] Field of Search ..... 482/66, 67, 68, 69; 297/5, 6, 485; 135/67; 280/1.5, 200, 276.1, 647, 650

[56] References Cited

U.S. PATENT DOCUMENTS

| | | | |
|---|---|---|---|
| 1,917,440 | 7/1933 | Finkbeiner | 482/67 |
| 4,342,465 | 8/1982 | Stillings | 482/68 |
| 4,770,410 | 9/1988 | Brown | 482/68 |

FOREIGN PATENT DOCUMENTS

| | | | |
|---|---|---|---|
| 0579543 | 8/1946 | United Kingdom | 482/67 |

*Primary Examiner*—Stephen R. Crow
*Attorney, Agent, or Firm*—Richard C. Litman

[57] ABSTRACT

A combination collapsible chair and walker device aids a handicapped user to move and to exercise in an independent manner. The device has a pair of upstanding complementary frame members laterally spaced apart from each other and connected by a two-part connecting tubular crossbar at its top front portion. Arm rests are attached to the frame for engaging the arm pits of the user. The device includes a swinging gate at its rear portion to allow a user to enter the device when raised. The gate is lowered when the device is in use to add structural integrity to the top and to provide for greater safety to the user by preventing the user from falling backwards out of the device. The frame members are mounted on a stable two-part wide base ring which is supported on swivel-type casters. A seat is mounted on the frame members and is formed of two hinged connected panels whereby the seat may be folded in half. The two-part connecting tubular member, the two-part wide base ring and the two hinged connected seat panels permit the device to be compactly collapsed for easy storage.

19 Claims, 3 Drawing Sheets

COMBINATION COLLAPSIBLE CHAIR AND WALKER DEVICE

BACKGROUND OF THE INVENTION

1. Field of the Invention

The present invention relates to a combination collapsible chair and walker device for aiding a handicapped person to move in an independent manner. More particularly, the present invention relates to a safe exercise combination collapsible chair and walker device having a stable wide base support, a seat which may be folded out of the way when not in use, and a collapsible frame for easy storage.

2. Description of the Prior Art

Combination chair and walker devices are well known, as exemplified by the following prior art:

U.S. Pat. No. 1,307,058 issued Jun. 17, 1919 to John I. McGrath, discloses a walking chair having wheels, arm pit supports and a seat.

U.S. Pat. No. 1,917,440, issued Feb. 17, 1932 to Adolf Finkbeiner et al., discloses a walker having a seat which may be adjusted to various heights and which may be folded into a compact structure.

U.S. Pat. No. 2,165,700, issued Jul. 11, 1939 to Henry Glynn, discloses a walker having a long support base with a semi-circular end at the front and back thereof.

U.S. Pat. No. 2,362,466, issued Nov. 14, 1944 to Frank E. Carter, discloses a walker having an elongated rectangular shaped base with an open front end.

U.S. Pat. No. 2,733,754, issued Feb. 7, 1956 to John G. Leslie et al., discloses an collapsible invalid walker which includes a foldable seat, armpit supports and casters.

U.S. Pat. No. 2,792,052, issued May 14, 1957 to Hans A. I. Johannesen, discloses an invalid walker and transfer device having a U-shaped base frame.

U.S. Pat. No. 3,273,888, issued Sep. 20, 1966 to Charles L. Burns, discloses an adjustable invalid walker having adjustable arm pads and pairs of wheels.

U.S. Pat. No. 3,778,052, issued Dec. 11, 1973 to Paul Andow et al., discloses a wheeled support having adjustable seat and crutch heads.

U.S. Pat. No. 4,068,857, issued Jan. 17, 1978 to Svan A. L. Karlsson, discloses apparatus which enables disabled persons to move independently and which includes wheels, seat and arm pits.

U.S. Pat. No. 4,231,582, issued Nov. 4, 1980 to Mark D. Moss, discloses a foldable infant's walker/bouncer having a round or ring-type base.

None of the above inventions and patents, taken either singly or in combination, is seen to describe the instant invention as claimed.

SUMMARY OF THE INVENTION

By the present invention, an improved combination collapsible chair and walker device is disclosed. The device aids a handicapped person to move and to exercise in an independent manner.

The device of the present invention includes a pair of upstanding complementary left and right frame members laterally spaced apart from each other and mounted on a single wide base ring. An arm rest is attached to each of the frame members for engaging the arm pits of the user. A connecting crossbar is pivotally attached to the top front ends of the two frame members. Pivotally attached to the top rear end of the left frame member is a gate which may be rotated to a closed position so as to engage a notch located on the right frame member at a top rear portion thereof. The gate may be swung open to allow entry by a user of the device.

A seat is pivotally mounted between the left and right frame members at the front of the walker and is formed of two hinged connected panel sections whereby the seat may be folded in half. The crossbar is formed of two tubular members pivotally attached together. The base ring has foldable sections at the front and back ends thereof. The foldable base ring and the two hinged connected seat panel sections along with the foldable crossbar permit the device to be compactly collapsed for easy storage.

The device constitutes a safe exercise combination chair and walker device having a stable wide base support, a seat which may be folded out of the way when not in use and a collapsible frame for easy storage. The device provides more mobility such a person than a walking cane or a pair of crutches can provide.

The wide base ring attached to the bottom of the frame members provides increased stability as the user of the device shifts weight from one side of the device to another. In this manner, even a person with poor balance is not in danger of falling over the device since the base of the device is wide enough to substantially prohibit it from tilting over. In the preferred embodiment the base is thirty-six (36) inches in diameter.

Six sets of wheel arrangements are located around the base ring of the device. Each wheel arrangement includes two wheels located side by side. Two wheel arrangements are located in the front of the device, two in the middle of the device, and two in the back of the device. The wheel arrangements are located around the bottom of the base ring equally spaced about the circumference thereof. The pair or wheel arrangements in the front do not rotate, while the middle and back pairs are swivel-type casters to allow the user to rotate and change directions easily.

The foldable and collapsible features of the combination chair and walker device provide many advantages. When the device is operative in the walking mode, the chair is folded up to be out of the way of the user's legs. When the device is operative in the sitting mode (for example when the user gets tired), the chair is folded down allowing the user to sit and rest is the chair. The base of the device has a sufficient wide diameter to substantially prevent it from tilting over whether the user is walking or sitting. However, the base of the device may be too wide to be easily stored or transported (for example, in a vehicle). Consequently, the foldable and collapsible structural features of the present invention permit the various folding parts of the device to be collapsed for easy storage and transportability.

Accordingly, it is a principal object of the invention to provide a combination chair and walker device to assist users such as patients who have undergone surgery or are in need of physical therapy to obtain the necessary ambulatory exercises required for their recovery or rehabilitation.

It is another object of the present invention to provide such a combination chair and walker device allowing patients the opportunity to obtain the necessary ambulatory exercises required for their treatment in a safe and secure manner by providing a stable base for assuring the device will not tilt over even if the patients are unable to maintain good balance while walking.

It is a further object of the invention to provide such a safe combination chair and walker device which providing adjustable armrests for accommodating users of various heights.

It is a further object of the invention is to provide such a user friendly safe combination chair and walker device which includes a foldable chair which may be lowered to allow the user to sit and rest after walking with the assistance of the device. The seat has structure to enable it to be raised so as to place the seat out of the way when the user desires to continue walking.

Still another object of the invention is to provide such a user friendly safe combination chair and walker device which is highly maneuverable by providing a circular base for the device for allowing the user to extend his or her legs sideways as easily as it is to extend his or her legs forward within the device.

It is still another object of the invention to provide a combination chair and walker device for folding in a collapsible condition by having a two-part connecting tubular member, a two-part base ring and a two hinged connected seat panel arrangement.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Before explaining in detail the present invention, it is to be understood that the invention is not limited in its application to the details of construction and arrangement of parts illustrated in the accompanying drawings, since the invention is capable of other embodiments and of being practiced or carried out in various ways. Also it is to be understood that the phraseology and terminology employed herein is for the purpose of describing a preferred embodiment only, and should not be construed as limiting the scope of the invention as set forth in the appended claims.

Figure 1:
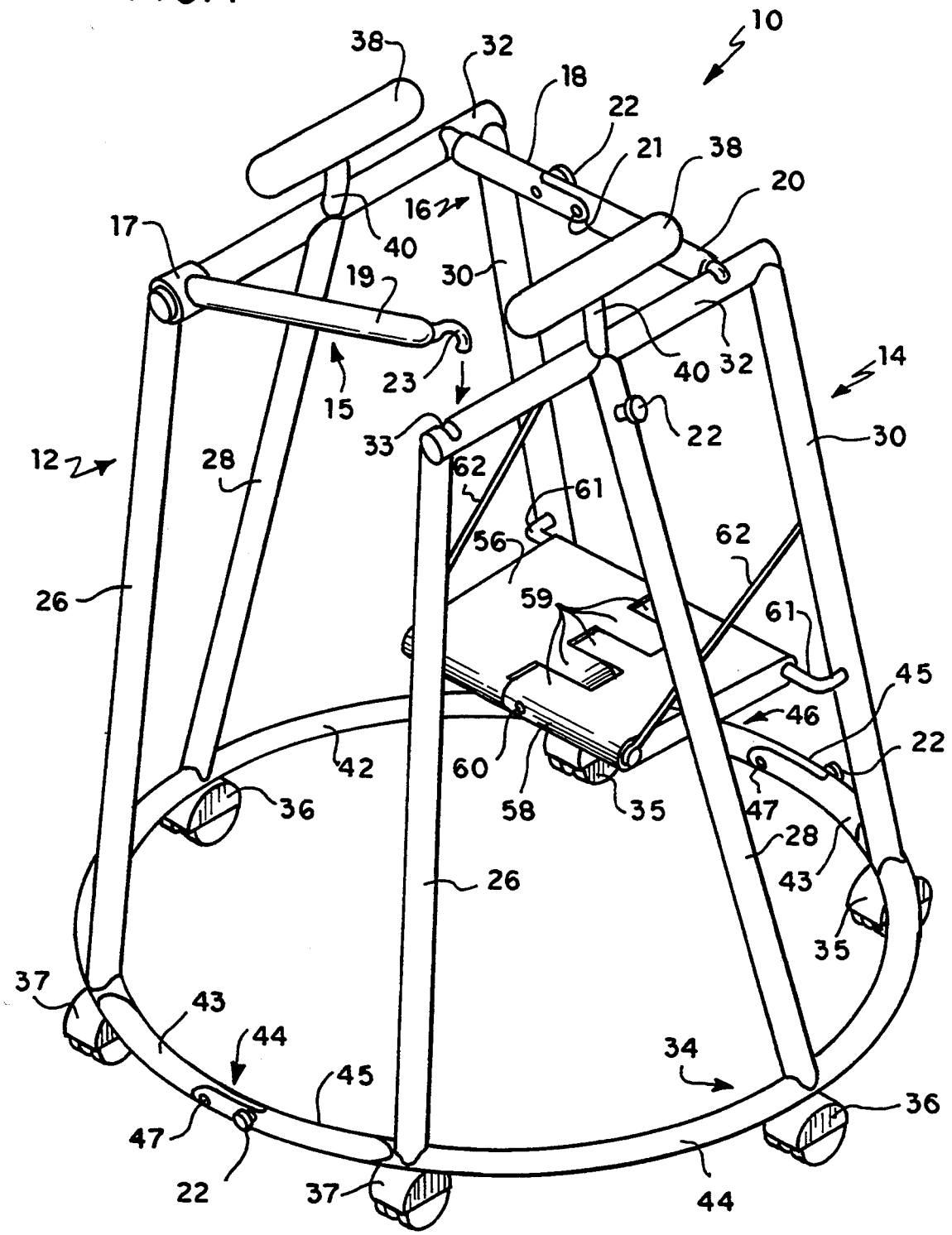
FIG. 1 is a perspective view of the combination chair and walker device.

Referring now to the drawings, particularly to FIG. 1, the embodiment of the present invention shows a combination collapsible chair and walker device 10 for aiding a handicapped person to use the device 10 in walking and sitting modes. Thus, the user can use the device 10 to move and to exercise in an independent manner. The device 10 includes a pair of upstanding complementary frame members 12 and 14 which are laterally spaced apart from each other, that is, a left frame member 12 and a right frame member 14.

The frame members 12, 14 are connected at a front top end by a collapsible connecting crossbar member 16. One end of the connecting bar member 16 is pivotally connected at one end to the left frame member 12 and the other end of the connecting bar member 16 is pivotally connected to the right frame member 14. The connecting crossbar member 16 is made in two substantially equal bar sections 18, 20 and are pivotally attached to one another at the end portions thereof by a joint 21 located in the middle of the connecting crossbar member 16.

Figure 3:
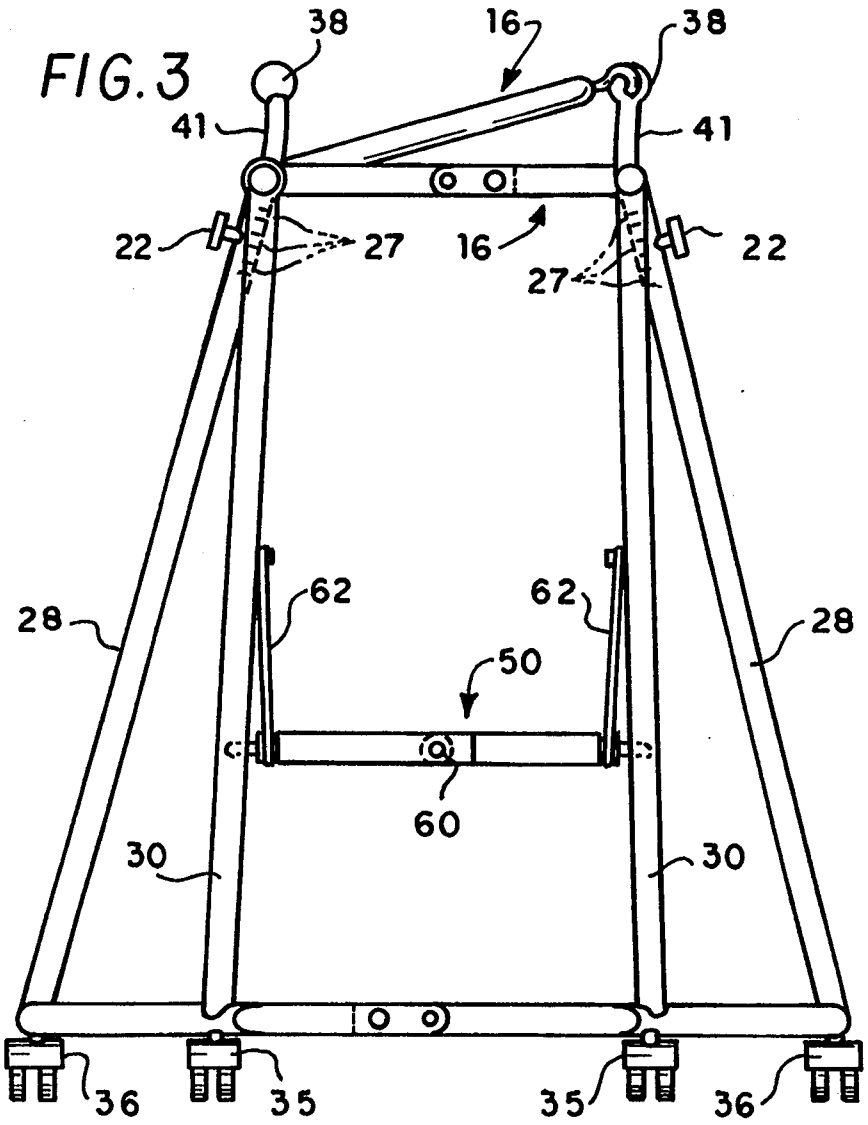
FIG. 3 is a front elevational view of the device, illustrating the seat in a lowered position.
Figure 2:
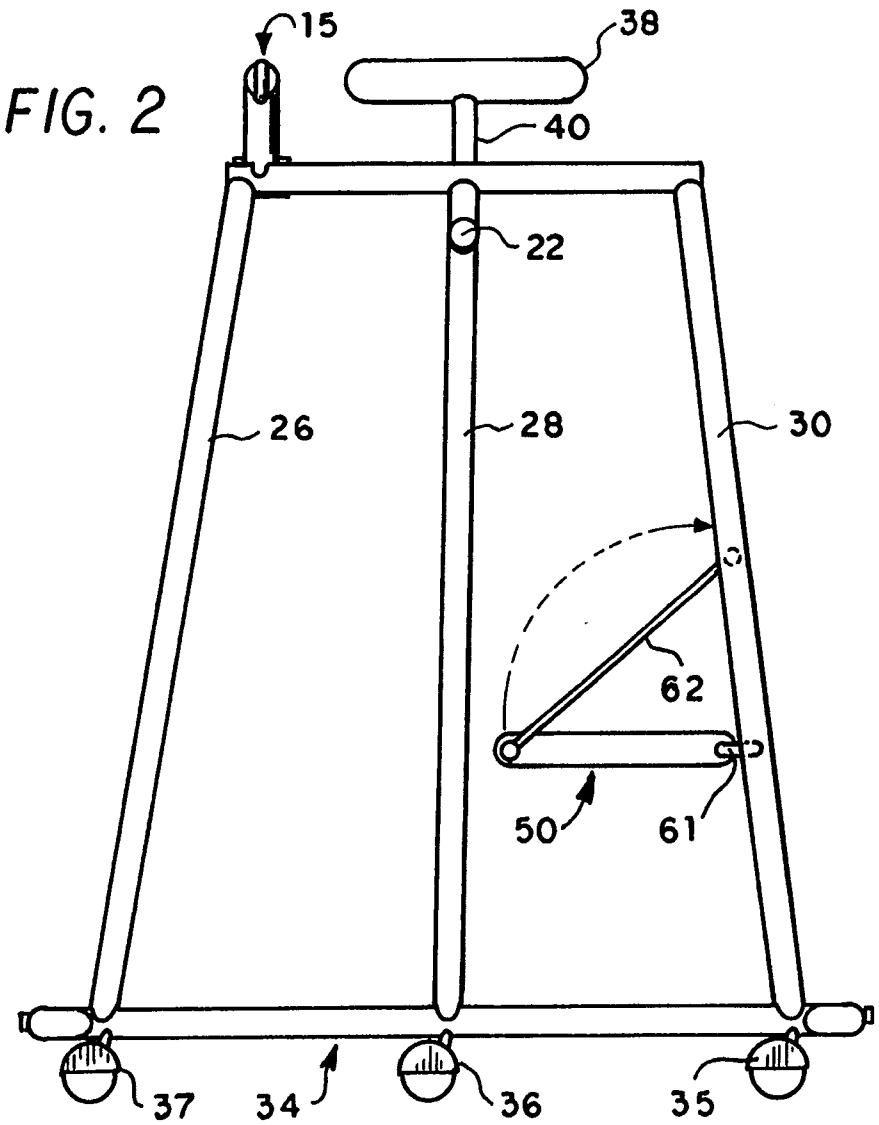
FIG. 2 is a side elevational view of the device, illustrating the seat in a lowered position.
Figure 4:
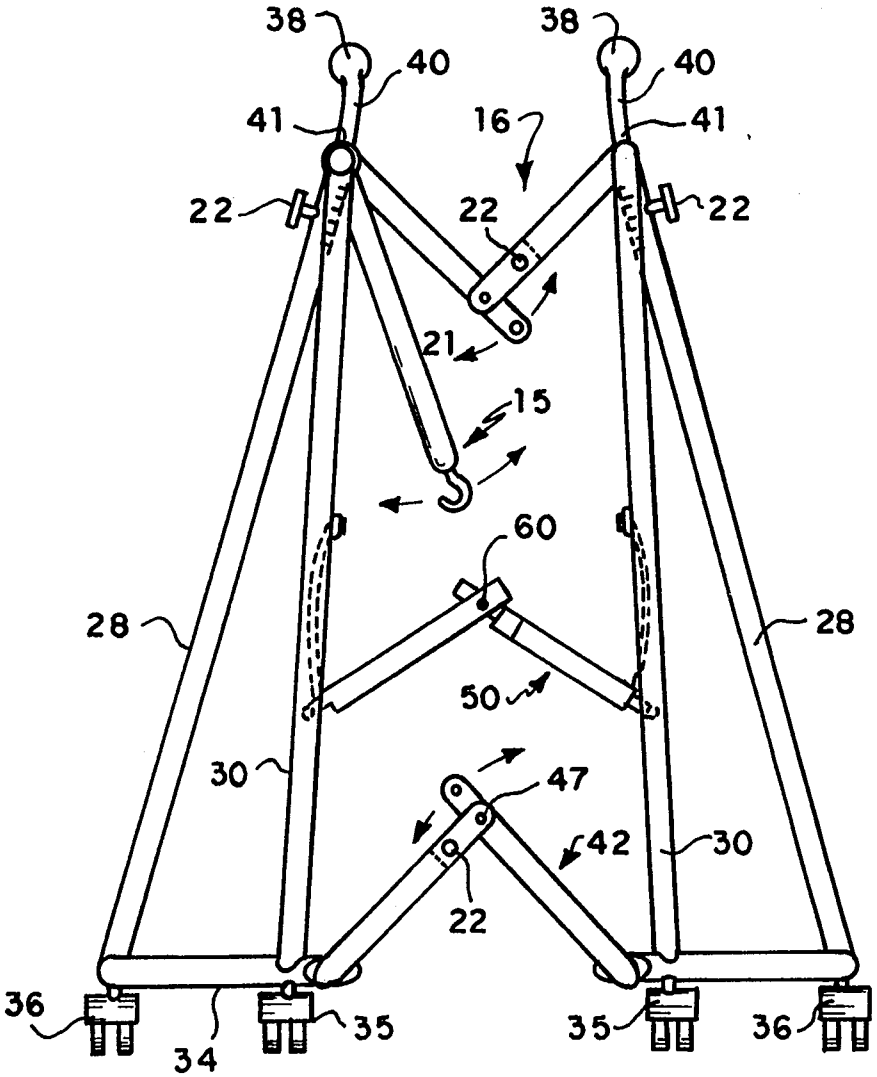
FIG. 4 is a front elevational view of the device in a partially collapsed position.

As illustrated in FIGS. 1 and 3, the two bar sections 18, 20 of the connecting crossbar member 16 are rigidly connected in an extended horizontal manner when the device 10 is being used in the walking and sitting modes. This is accomplished through the use of a locking pin arrangement 22 which can be manually positioned so as to extend through both the bar sections 18, 20. As illustrated in FIG. 4, the bar sections 18 and 20 of the connecting crossbar member 16, which is in an unlocked condition, are in a nearly folded and collapsed position.

Each of the complementary left and right frame member 12, 14 aids in the stability of the device 10. Each of the frame members 12, 14 have three upstanding leg members 26, 28, 30. The respective leg members 26 are positioned at the back of the device 10. The respective leg members 30 are positioned at the front of the device 10. The respective leg members 28 are located midway between the respective back leg members 26 and the front leg members 30. Each of the top ends of the leg members 26, 28, 30 are connected by a short horizontal connecting rod 32. The bottom end of the leg members 26, 28, 30 are connected to a base ring 34. The tubular members of the device 10, namely, the connecting bar member 16, the leg members, the connecting rod 32 and the base ring 34, preferably are made of hollow metallic tubes.

As shown in FIG. 1, the connections between the tops of the respective leg members 26, 28, 30 are spaced a short equal distance from each other along the respective connecting rod 32. Each of the bottom ends of the leg members 26, 28, 30 are connected in an equal spaced arrangement around the supporting base ring 34. The rigid connections between the tops and bottoms of the respective leg members may be welded connections or the like. The connecting crossbar member 16 adds greater structural integrity to the device 10 as well as additional safety to the user by preventing the user from falling forward between the left and right frame members 12, 14. To add additional safety, a gate 15 is provided in the back of the device 10 to prevent a user from falling backwards between the left and right frame members 12, 14. In addition, the gate 15 adds structural integrity to the top rear portion of the device 10 when closed.

As illustrated in FIG. 1, the gate 15 is pivotally connected to the connecting rod 32 located on the left of the device 10. A sleeve 17 is located in a fixed location about the back end of the connecting rod 32 on the left side of the device 10. A gate bar 19 extends out from the sleeve and has a hook 23 at the end thereof. The gate 15 may be rotated in the clockwise direction as shown in FIG. 1 so as to cause the hook 23 to engage an eye notch 33 located on the back end of the connecting rod 32, thereby maintaining the gate in its closed position.

As shown in FIG. 1, six sets of wheel arrangements are located around the base ring 34 of the device 10. Each wheel arrangement includes two wheels located side by side. Two wheel arrangements 35 are located in the front of the device 10, two wheel arrangements 36 are located in the middle of the device 10, and two wheel arrangements 37 are located in the back of the device 10. The wheel arrangements 35, 36, and 37 are located around the bottom of the base ring equally spaced about the circumference of the base ring 34 directly below one of the leg members 26, 28, or 30. The pair of wheel arrangements 35 located in the front do not rotate while each wheel arrangements 36 and 37 are swivel-type casters to allow the user to rotate and change directions easily.

Figure 5:
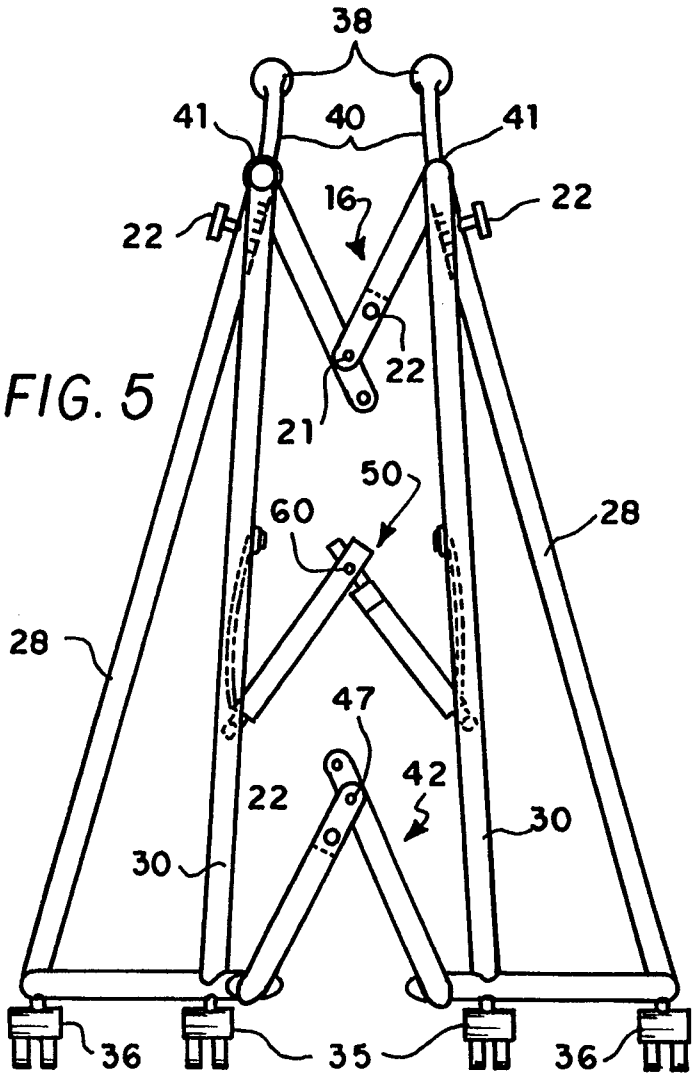
FIG. 5 is a front elevational view of the device in an almost completely collapsed or folded position.

A pair of horizontally positioned elongated padded underarm supports 38 are mounted on a short tubular members 40. The underarm supports 38 are fixedly attached on the bottom sides thereof to short tubular members 40. Each short tubular members 40 is slightly smaller in diameter than the diameter of the particular tubular leg member 28 which are mounted immediately below the respective short tubular member 40. The short tubular members 40 are frictionally fitted within the leg members 28. As shown in FIGS. 3–5 the short tubular members 40 have bent portions 41 to enable the members 40 to fit within the leg members 28 which are inclined with respect to the horizontally positioned base ring 34. Further, each short tubular member 40 is locked in the appropriate position by a locking pin arrangement 22. As illustrated in FIG. 3, there are a plurality of slots 27 located along the length of each short tubular member 40 to allow the height of the underarm supports 38 to be adjustable.

The supporting base ring 34 includes a pair of arcuate base frame members 42 and 44 having wheel arrangements 35 and leg members 30 attached at a front end thereof, while having wheel arrangements 37 and leg members 26 attached at a back end thereof. The connections for the two respective ends of the arcuate base frame sections 36, 38 are similar to the connection for the front top ends of the two frame members 12 and 14. The connections of each of the arcuate base frame members 42 and 44 include arcuate crossbar members 44 and 46. Each of the crossbar members 44 and 46 include arcuate sections 43 and 45, having far ends pivotally connected to respective ends of the arcuate base frame members 42 and 44 and adjoining ends pivotally attached to one another by a pin 47. The adjoining ends of the arcuate sections 43 and 45 also include locking pin arrangement 22 for rigidly connecting the adjoining ends thereof so as to prevent the crossbar members 44 and 45 from bending about the middle portions thereof.

The device 10 includes a foldable seat 50 which may be lowered when the user wishes to rest and may be raised out of the way when the user wishes to resume walking. The foldable seat consists of a two sectional panel including a first panel section 56 and a second panel section 58. Each of the first and second panel sections 56, 58 have extending tongue members 59. The extending tongues 59 of each of said respective panels 56, 58 are pivotally connected to one another through the use of a pin 60. The seat 50 includes connecting elbows 61 pivotally attached to the leg members 30. The first and second panels 56, 58 are in the horizontal plane when the seat 50 is in the operative seating mode. The seat 50 is pivotally attached to the connecting elbows 61. Cables 62 are attached to both the seat 50 and the leg members 30 maintain seat 50 in a horizontal position when lowered.

FIGS. 4 and 5 illustrate the collapsibility of the device 10. The device 10 is collapsed to take up less space when stored or transported from one location to another. As illustrated, once the locking pin arrangements 22 of the connecting crossbar member 16 and the arcuate base frame members 42 and 44 are disengaged, the members 16, 42, and 44 are folded in the middle. The seat 50 in its lowered position also folds in the middle.

It is to be understood that the present invention is not limited to the sole embodiment described above, but encompasses any and all embodiments within the scope of the following claims.

I claim:

1. A combination collapsible chair and walker device for aiding a handicapped user to move and to exercise in an independent manner, comprising:

a pair of upstanding complementary frame members laterally spaced apart from each other;

a collapsible connecting tubular member at a top front end of said device and connecting said pair of frame members;

a gate located at a back end of said device for permitting entry by the user when opened;

an arm rest attached to each of said frame members and extending upwardly therefrom;

there further being a collapsible wide base ring for mounting said pair of frame members;

a plurality of swivel-type casters supporting said base ring, including a pair of front swivel-type casters located in the front bottom end of said device, said front swivel-type casters positioned in a fixed forward direction for allowing said device to be easily guided forward; and a seat mounted on said pair of frame members and formed of panel sections whereby the seat may be folded in a collapsed condition;

wherein said collapsible connecting tubular member, said collapsible wide base ring and said collapsible seat panel sections permit the device to be compactly collapsed for easy storage.

2. A combination collapsible chair and walker device according to claim 1, wherein said pair of frame members, said connecting member and said base ring are hollow metal tubes.

3. A combination collapsible chair and walker device according to claim 1, wherein said collapsible connecting tubular member is constructed in two parts.

4. A combination of collapsible chair and walker device according to claim 1, wherein said pair of frame members are a plurality of laterally spaced apart leg members.

5. A combination collapsible chair and walker device according to claim 1, wherein said collapsible connecting tubular member is pivotally connected at one end thereof to one of said complementary frame members and at the other end thereof to other of said complementary frame members.

6. A combination collapsible chair and walker device according to claim 1, wherein said collapsible connected tubular member comprises two tubular sections pivotally attached to one another at a middle portion of said collapsible connecting member, said connecting member further including locking means for preventing said collapsible connecting member from folding along said middle portion thereof.

7. A combination collapsible chair and walker device according to claim 1, wherein said collapsible wide base ring is constructed of a pair of arcuate frame sections, the opposite ends of which are positioned opposite one another.

8. A combination collapsible chair and walker device according to claim 7, wherein said pair of arcuate frame sections are secured by respective connecting means.

9. A combination collapsible chair and walker device according to claim 1 wherein said collapsible connecting panel sections of said seat are a first panel and a second panel, each of said first and second panels having extending tongues, said extending tongues of each of said respective panels engaging each other to form a hinge connection, whereby said first and second panels are in the horizontal plane when said seat is in a lowered horizontal position and are in the vertical plane when said seat is in a raised position.

10. A combination collapsible chair and walker device comprising:

a pair of upstanding complementary frame members, laterally spaced apart from each other;

a collapsible connecting member at a top front end of said device connecting said pair of frame members;

a gate at a back end of said device to permit entry by a user when opened;

an arm rest attached to each of said frame members;

a collapsible wide base ring to which said pair of frame members are mounted;

a plurality of swivel-type casters attached to the bottom of said base ring, including a pair of front casters maintained in a fixed direction so as to allowing said device to be easily guided in a forward direction; and a seat mounted on said frame members and formed of two hinged connected panels whereby the seat may be folded in half;

wherein said collapsible connecting member, said collapsible wide base ring and said two-part hinged connected seat panels permit the device to be compactly collapsed for easy storage.

11. A combination collapsible chair and walker device according to claim 10, wherein said pair of frame members, said connecting member and said base ring are hollow metal tubes.

12. A combination collapsible chair and walker device according to claim 10, wherein said pair of frame members are a plurality of laterally spaced apart leg members.

13. A combination collapsible chair and walker device according to claim 10, wherein said collapsible connecting tubular member is constructed in two parts.

14. A combination collapsible chair and walker device according to claim 10, wherein said collapsible wide base ring is constructed of a pair of arcuate frame sections, the opposite ends of which are positioned opposite one another.

15. A combination collapsible chair and walker device according to claim 10, wherein said pair of arcuate frame sections are secured by respective connecting means.

16. A combination collapsible chair and walker device according to claim 10, wherein said two-part connecting panel sections of said seat are a first panel and a second panel, each of said first and second panels having extending tongues on one edge thereof, said extending tongues of each of said respective panels engaging each other to form a hinge connection, whereby said first and second panels are in the horizontal plane when said seat is in the operative seating position and are in the vertical plane when said seat is in the collapsible storage position.

17. A combination collapsible chair and walker device for aiding the independent mobility of a user in walking and sitting modes and for folding said device into a collapsible condition in a storage mode; comprising:

a left frame member and a right frame member of complementary construction laterally spaced apart from each other;

a collapsible connecting member at a top rear end of the device and connecting said pair of frame members;

an arm pad adjustably mounted on each of said left and right frame members;

means associated with each of said arm pads for adjusting the height of said respective arm pad;

a foldable seat means mounted on said left and right frame members for supporting the legs of the user at a convenient level in the sitting mode;

said seat means having a first panel section and a second panel section, each of said first and second panel sections having extending tongues on one edge thereof, said respective extending tongues engaging each other, whereby when said first and second panels are in a hinged relationship with respect to each other; whereby an operative sitting position of the seat means is ascertained when said first and second panel sections are positioned in a planar manner in a horizontal plane and when said first and second panel sections are folded with respect to each other to ascertained a collapsible condition for the storage mode;

a circular base means for supporting said combination chair and walker device for movement over a floor in a stable upright condition in the walking mode;

a plurality of wheels equally spaced and swivel mounted on said base support;

said circular base means including a pair of arcuate base frame sections, the opposite ends of which are positioned opposite one another;

means for connecting said pair of arcuate base frame sections at their respective ends; whereby in operative walking and sitting modes, the pair of arcuate base frame sections are rigidly connected together and in the storage mode, the pair of arcuate base frame sections are in a collapsible condition; and means mounting said frames for horizontal movement relative to each other for varying the width between the frames.

18. A combination collapsible chair and walker device according to claim 17, wherein said pair of frame members, said connecting member, and said base ring means are hollow metal tubes.

19. A combination of collapsible chair and walker device according to claim 17, wherein said pair of frame members are a plurality of laterally spaced apart leg members.

* * * * *